United States Patent [19]

Nguyen et al.

[11] Patent Number: 4,793,414

[45] Date of Patent: Dec. 27, 1988

[54] STEAM INJECTION PROFILING

[75] Inventors: Tanh V. Nguyen, Fullerton, Calif.; C. Brent Davenport, Houston, Tex.

[73] Assignee: Chevron Research Company, San Francisco, Calif.

[21] Appl. No.: 88,465

[22] Filed: Aug. 19, 1987

Related U.S. Application Data

[63] Continuation-in-part of Ser. No. 935,662, Nov. 26, 1986, abandoned.

[51] Int. Cl.[4] ..... E21B 43/24; E21B 49/08

[52] U.S. Cl. ..... 166/252; 166/303

[58] Field of Search ..... 166/250, 252, 272, 303; 73/155

[56] References Cited

U.S. PATENT DOCUMENTS

| | | | |
|---|---|---|---|
| 3,123,708 | 3/1964 | Limanek | 73/155 X |
| 3,524,502 | 8/1970 | Sloan | 166/250 |
| 4,085,798 | 4/1978 | Schweitzer et al. | 166/252 |
| 4,102,185 | 7/1978 | Dowling et al. | 73/155 |
| 4,223,727 | 9/1980 | Sustek, Jr. et al. | 166/250 |
| 4,228,855 | 10/1980 | Sustek, Jr. et al. | 166/250 |
| 4,249,603 | 2/1981 | Skogen | 166/251 |
| 4,409,825 | 10/1983 | Martin et al. | 73/155 |
| 4,501,325 | 2/1985 | Frazier et al. | 166/252 X |
| 4,581,926 | 4/1986 | Moore et al. | 73/155 |

OTHER PUBLICATIONS

W. R. McLeod et al., "Radiotracers in Gas-Liquid Transportation Problems-a Field Case", *Journal of Petroleum Technology*, Aug. 1971, pp. 939-947.

V. E. Schrock, "Radiation Attenuation Techniques in Two-Phase Flow Measurements", presented at 11th National ASME/AICHE Heat Transfer Conference, Aug. 3-6, 1969.

T. R. Heidrick et al., "Application of a 3-Beam & Densitometer to Two-Phase Flow Regime and Density Measurements", AICHE Symposium Series, V. 73, No. 164.

Lichtenberger, G. J., "A Primer on Radioactive Tracer Injection Profiling", SPE reprint No. 118-132, SPE, 1985.

D. E. Bookout et al., "Injection Profiles During Steam Injection", paper No.801-43C, pp. 1-16, May 3, 1967.

T. D. Elson, "Phase Separation of Two-Phase Fluid in an Injection Wellbore," SPE 9916, 1981.

Tinker, G. E., "Gas Injection with Radioactive Tracter to Determine Reservoir Continuity", *Journ. of Petrol. Tech.*, p. 1251 (11/73).

Wagner, O. R., "The Use of Tracers in Diagnosing Interwell Reservoir Heterogeneities", *Journ. of Petrol. Tech.*, p. 1410 (11/77).

*Primary Examiner*—George A. Suchfield

*Attorney, Agent, or Firm*—S. R. LaPaglia; E. J. Keeling

[57] ABSTRACT

An improved method and apparatus for determining injection profiles in a steam injection well is disclosed. The mass flow rate and quality of steam entering the well is measured. A well logging tool is then used to measure temperature and/or pressure profiles within the perforated zone of the well. A liquid phase tracer is then injected for a short time into the well with the steam. The well logging tool contains dual gamma ray detectors and is used to measure the transit time of the tracer slug. In the preferred embodiment, the liquid tracer is radioactive elemental iodine or sodium iodide. The procedure is repeated with a vapor phase tracer which is radioactive Krypton, Argon, or Xenon in the preferred embodiment. A vapor and liquid profile can then be calculated with simple mass balance equations. In a second approach, a spinner survey and a single tracer survey are conducted. By combining the spinner and tracer survey results, vapor and liquid rates can be determined and steam injection profiles can be calculated.

4 Claims, 2 Drawing Sheets

STEAM INJECTION PROFILING

This is a continuation of copending application Ser. No. 935,622, filed on Nov. 26, 1986, now abandoned.

FIELD OF THE INVENTION

This invention relates generally to thermally enhanced oil recovery. More specifically, this invention provides a method and apparatus for accurately developing steam injection profiles in steam injection wells.

BACKGROUND OF THE INVENTION

In the production of crude oil, it is frequently found that the crude oil is sufficiently viscous to require the injection of steam into the petroleum reservoir. Ideally, the petroleum reservoir would be completely homogeneous and the steam would enter all portions of the reservoir evenly. However, it is often found that this does not occur. Instead, steam selectively enters a small portion of the reservoir while effectively bypassing other portions of the reservoir. Eventually, "steam breakthrough" occurs and most of the steam flows directly from an injection well to a production well, bypassing a large part of the petroleum reservoir.

It is possible to overcome this problem with various remedial measures, e.g., by plugging off certain portions of the injection well. For example, see U.S. Pat. Nos. 4,470,462 and 4,501,329, assigned to the assignee of the present invention. However, to institute these remedial measures, it is necessary to determine which portions of the reservoir are selectively receiving the injected steam. This is often a difficult problem.

Various methods have been proposed for determining how injected steam is being distributed in the wellbore. Bookout ("Injection Profiles During Steam Injection", SPE Paper No. 801-43C, May 3, 1967) summarizes the known methods for determining steam injection profiles and is incorporated herein by reference for all purposes.

The first and most widely used of these methods is known as a "spinner survey". A tool containing a freely rotating impeller is placed in the wellbore. As steam passes the impeller, it rotates at a rate which depends on the velocity of the steam. The rotation of the impeller is translated into an electrical signal which is transmitted up the logging cable to the surface where it is recorded on a strip chart or other recording device.

As is well known to those skilled in the art, these spinners are greatly affected by the quality of the steam injected into the well, leading to unreliable results or results which cannot be interpreted in any way.

Radioactive tracer surveys are also used in many situations. With this method methyl iodide (131) has been used to trace the vapor phase. Sodium iodide has been used to trace the liquid phase. The radioactive Iodine is injected into the steam between the injection well and the steam generator. The tracer moves down the tubing with the steam until it reaches the formation, where the tracer is temporarily held on the face of the formation for several minutes. A typical gamma ray log is then run immediately following the tracer injection. The recorded gamma ray intensity at any point in the well is then assumed to be proportional to the amount of steam injected at that point.

The vapor phase tracers have variously been described as alkyl halides (methyl iodide, methyl bromide, and ethyl bromide) or elemental iodine. It has been found that the above materials undergo chemical reactions that dramatically affect the accuracy of the results of the survey.

It is, therefore, desirable to devise a highly accurate method of developing steam profiles in steam injection wells.

SUMMARY OF THE INVENTION

Field trials with the most common radioactive tracer, methyl iodide, were run to determine its effectiveness as a vapor tracer. It was found that a significant percentage of methyl iodide decomposes into liquid soluble components shortly after injection.

It is also believed that significant errors in measurement will occur when elemental iodine is used, as well as the alkyl halides other than methyl iodide. Further errors in the use of prior art tracers result from the assumption that tracers "plate out" in the formation and the assumption that gamma ray intensity is proportional to flow at a given depth.

Therefore, we have devised a method of determining the steam profile in a steam injection well using improved tracers and actual liquid and vapor velocities. A logging tool with temperature and/or pressure measurement devices and dual gamma ray detectors is placed in the injection well. Temperature and/or pressure logs are then run to determine vapor and liquid densities. The dual gamma ray logging tool is then placed in the formation at a known depth. After determining the mass flow rate and quality of steam entering the well, liquid phase tracers and thermally stable, irradiated vapor phase tracers are injected into the flowing steam at the wellhead and detector outputs are recorded to calculate transit time between the detectors.

This procedure is repeated at different positions in the wellbore to obtain an injection profile.

Alternatively, the improved liquid phase tracer or vapor phase tracer can be used in conjunction with a traditional spinner survey to determine both liquid and vapor profiles.

DETAILED DESCRIPTION OF THE INVENTION

Figure 1:
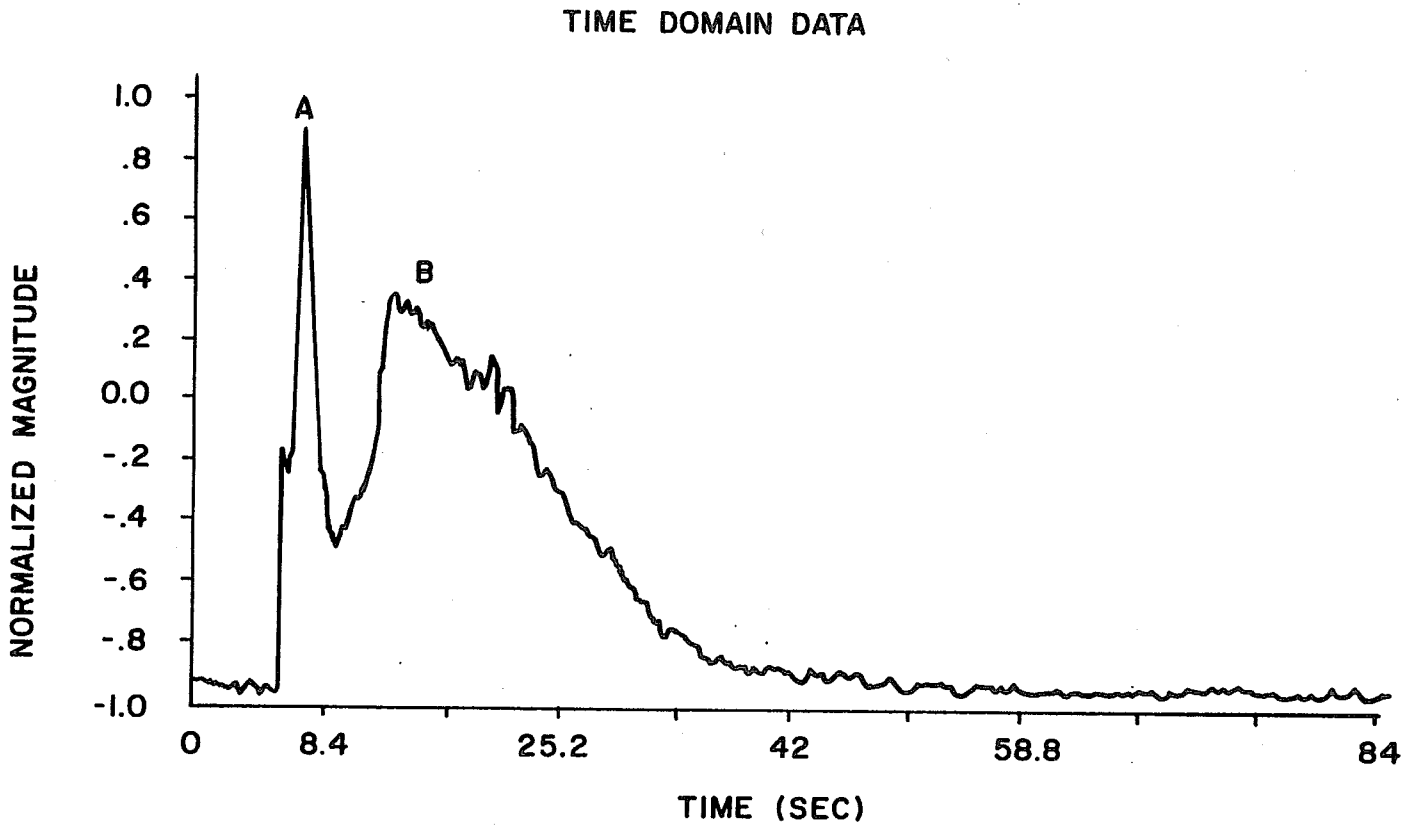
FIG. 1 is a plot showing the gamma ray detector outputs for a methyl iodide survey.

Surprisingly, it has been found that up to 89 percent of the methyl iodide injected into a steam injection well hydrolyzes within 10 seconds exposure to typical injection well conditions. In a field trial, methyl iodide was injected into the well and traveled into the formation in about 10 seconds. Gamma ray detector outputs (as shown in FIG. 1) show two distinct peaks characteristic of methyl iodide in the vapor phase (peak A) and decomposition products in the liquid phase (peak B). Calculations of the area under these two curves show that 89 percent of the methyl iodide is found in the liquid. Note that peak B shows strong dispersion characteristic of a liquid signal.

Methyl iodide and other alkyl halide tracers are believed by the inventors herein to degrade according to the following reactions in a steam injection well within the time required for the tracers to reach the formation:

Methyl iodide: $CH_3I + H_2O \rightarrow CH_3OH + HI$

Ethyl iodide: $C_2H_5I+H_2O \rightarrow C_2H_5OH+HI$ (with a possible side reaction:

$C_2H_5I \rightarrow C_2H_4+HI$)

Methyl bromide: $CH_3Br+H_2O \rightarrow CH_3OH+HBr$

Ethyl bromide: $C_2H_5Br+H_2O \rightarrow C_2H_5OH+HBr$

Due to the high solubility and low vapor pressure of HI and HBr, the reaction products will virtually totally equilibrate into the liquid phase of the steam. Also, HI and HBr are strong acids while the liquid phase of the steam is very basic, so once the HI or HBr equilibrates into the liquid phase, they will be converted to salts which are totally water-soluble. Therefore, when a portion of an alkyl halide vapor phase tracer thermally degrades (hydrolyzes) within the wellbore, the liquid phase of the steam will also be traced. When all of the vapor phase tracer has hydrolyzed, virtually only the liquid phase will be traced. These problems make it virtually impossible to formulate an accurate injection profile.

Figure 2:
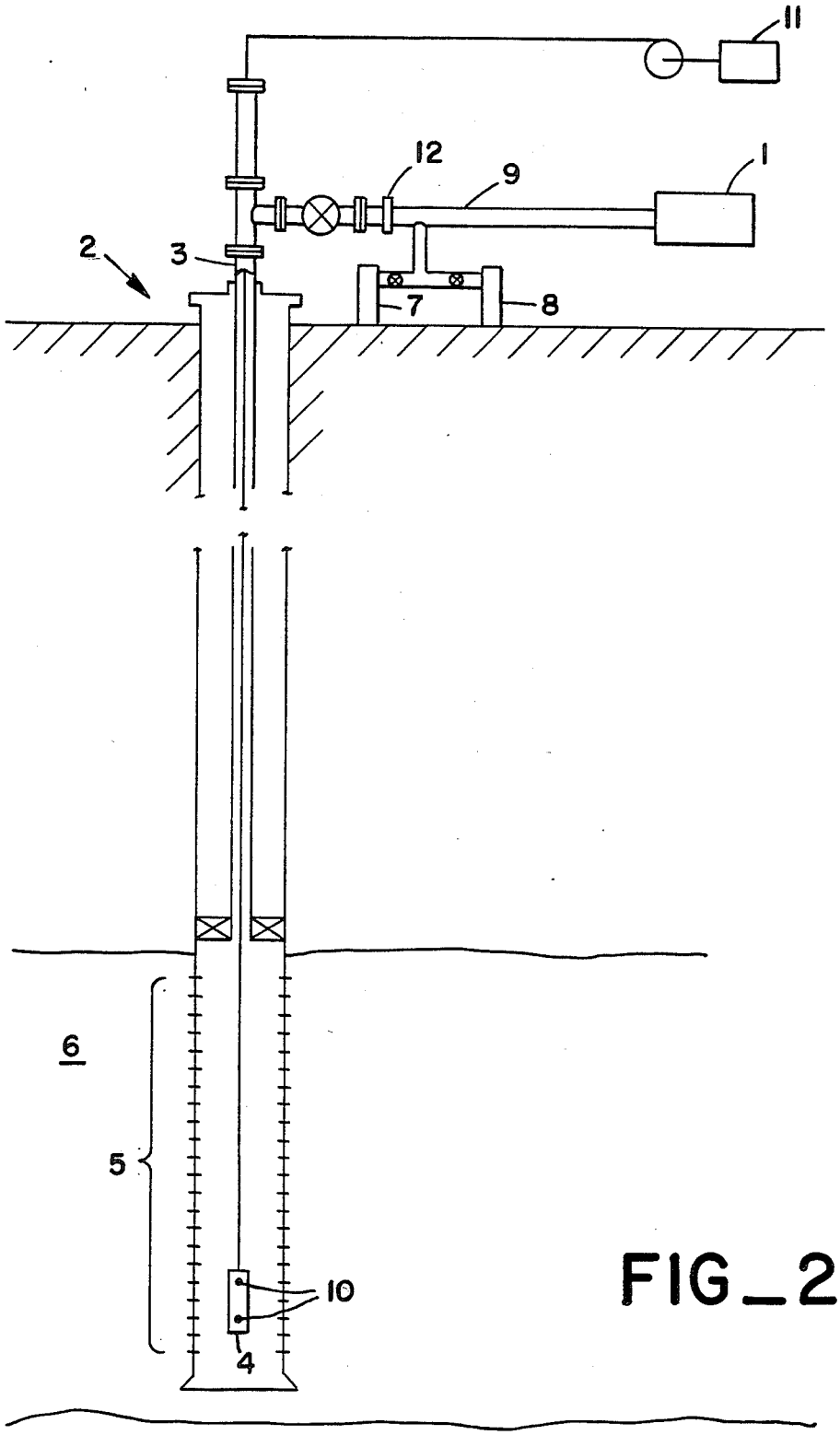
FIG. 2 schematically illustrates the method and apparatus used in the first preferred embodiment.

Therefore, an improved method and means of determining the steam injection profile of a steam injection well has been devised. FIG. 2 schematically illustrates the method and apparatus of the first preferred embodiment. Steam is generated in steam generator 1 and injected into steam injection well 2 through tubing 3 and perforations 5 into petroleum formation 6. It is important in the practice of the present invention that the steam rate and quality be maintained at a relatively constant level, so conditions should be stabilized before the method is carried out. The steam mass flow rate and quality is determined at the wellhead with flow rate and quality measurement equipment 12.

Initially, a well logging tool 4 is used to develop temperature and/or pressure profiles which enable the determination of vapor and liquid densities from steam tables. Well logging tool 4 is then returned to the bottom of perforated zone 5. A slug of liquid phase tracer 7 is then injected into steam line 9. In the preferred embodiment, liquid phase tracer 7 is elemental iodine 131 or sodium iodide. A sufficient quantity is injected to permit easy detection at the gamma ray detectors. This quantity will vary radially depending on the steam flow rate and steam quality, but can readily be calculated by one skilled in the art.

Logging tool 4 is of a type well known in the art and contains gamma ray detectors 10. Instrumentation and recording equipment 11 is used to record the transit time for the passing slug of tracer between the detectors 10. Logging tool 4 is then moved upward in the wellbore and the above procedure is repeated.

After data have been gathered using the liquid phase tracer 7, logging tool 4 is returned to the bottom of the perforated zone and the above procedure is repeated using thermally stable vapor phase tracer 8. In the preferred embodiment, vapor phase tracer 8 is Krypton 85, Argon, Xenon 133, or other irradiated, thermally stable gases.

The vapor and liquid flow rates at each location in the perforated zone can now be determined respectively with the equations:

$$V_V = L/T_V \tag{1}$$

$$V_L = L/T_L \tag{2}$$

where:

$V_V$=Vapor velocity;

$V_L$=Liquid velocity;

L=The distance between detectors 10;

$T_V$=Vapor transit time; and $T_L$=Liquid transit time.

From a simple mass balance, it is also found that:

$$W = [\rho_V \alpha V_V + \rho_L (1-\alpha) V_L] A \tag{3}$$

where:

W=The mass flow rate measured at each tool location;

A=The wellbore cross-sectional area corrected for the presence of the logging tool;

$\rho_V$ and $\rho_L$=The vapor and liquid phase densities (determined from the temperature logs, the pressure logs, or from both); and $\alpha$=The downhole void fraction.

Solving for $\alpha$ from Equation (3) yields:

$$\alpha = \frac{\frac{W}{A} - \rho_L V_L}{\rho_V V_V - \rho_L V_L} \tag{4}$$

The downhole steam quality above the top perforated zone, i.e., at the tubing tail, can then be calculated from the equation:

$$x = \frac{\rho_V \alpha V_V}{\rho_V \alpha V_V + \rho_L (1-\alpha) V_L} \tag{5}$$

where:

x=Steam quality above the top perforated zone $\alpha$ is given by equation 4 where W is the steam flow rate measured at the wellhead.

Beginning at the top of the perforations, the vapor and liquid profiles can now be determined. Since the total mass flow rate into the well is known, the vapor and liquid flow rates at the top of the perforated interval (designated station "1") can be calculated from the equations:

$$W_{V1} = (W)(x) \tag{6}$$

$$W_{L1} = (W)(1-x) \tag{7}$$

where:

$W_{V1}$=The vapor mass flow rate at station 1.

$W_{L2}$=The liquid mass flow rate at station 1.

The amount of vapor and liquid leaving the wellbore between station 1 and station 2 is now given by the equations:

$$W_{WV1} = W_{V1}\left[1 - \left[\frac{\alpha_2}{\alpha_1} \; \frac{T_{V1}}{T_{V2}}\right]\right] \tag{8}$$

$$W_{WL1} = W_{L1}\left[1 - \left[\frac{(1-\alpha_2)}{(1-\alpha_1)} \; \frac{T_{L1}}{T_{L2}}\right]\right] \tag{9}$$

The vapor and liquid mass flow rates at station 2 are now given by the equations:

$$W_{V2} = W_{V1} - W_{WV1}$$

$$W_{L2}=W_{L1}-W_{WL1}$$

The above calculations can now be performed at every location in the wellbore where data have been taken. In general, the amount of vapor and liquid entering the formation between station i and station (i+1) will be given by the equations:

$$W_{WVi} = W_{Vi}\left[1-\left[\frac{\alpha_i+1}{\alpha_i}\ \frac{T_{Vi}}{T_{V(i+1)}}\right]\right] \quad (10)$$

$$W_{WLi} = W_{Li}\left[1-\left[\frac{(1-\alpha_{(i+1)})}{(1-\alpha_i)}\ \frac{T_{Li}}{T_{L(i+1)}}\right]\right] \quad (11)$$

As an alternative to the above procedure, a single tracer can be used (for either the vapor or liquid phase, as described above) in combination with a spinner survey of the type well known to one skilled in the art. In this method, the spinner can be used to extract the total mass flow rate at any given point within the perforated zone. Simple mass balance equations can then be used to develop a profile along the perforated zone. In this approach, the spinner response is represented by the following equations:

$$\text{rps}=f(W_V, W_L, X) \quad (12)$$

where:

rps=the spinner response $W_V$=the vapor flow rate $W_L$=the liquid flow rate

X=the steam quality

The tracer survey results are used to calculate the flow rate of one phase ($W_V$ or $W_L$). Equation (12) is then used to calculate the other flow rate ($W_L$ or $W_V$). The above-described vapor or liquid tracers are used.

It is to be understood that the above-described embodiments are intended to be illustrative and not restrictive. For example, the order of the above-described steps could readily be varied. For that reason, the scope of the invention is not to be limited by the above-described embodiments, but instead by the appended claims along with the full range of equivalents thereto.

What is claimed is:

1. A method of determining liquid and vapor phase steam profiles in a steam injection well comprising the steps of:

(a) inserting a well logging tool into a steam injection well at a first location, said logging tool further comprising dual gamma ray detectors;

(b) measuring a mass flow rate of steam entering the steam injection well;

(c) injecting an irradiated, liquid phase tracer into the steam injection well;

(d) determining a liquid transit time with said logging tool;

(e) injecting an irradiated, thermally stable vapor phase tracer into the steam injection well;

(f) determining a vapor transit time with said logging tool;

(g) moving said logging tool to a second location;

(h) repeating steps (c), (d), (e), and (f); and (i) calculating an amount of vapor and an amount of liquid entering a formation between said first location and said location based on said mass flow rate of steam entering the well, said liquid transit times, and said vapor transit times.

2. The method as recited in claim 1 wherein said thermally stable vapor phase tracer is selected from the group irradiated Argon, irradiated Krypton or irradiated Xenon.

3. A method of determining liquid and vapor phase steam profiles in a steam injection well comprising the steps of:

(a) inserting a well logging tool into a steam injection well;

(b) measuring a mass flow rate of steam entering the injection well;

(c) performing a spinner survey of a perforated zone of the steam injection well to determine a mass flow rate of steam at a first station;

(d) injecting a thermally stable vapor phase tracer into the steam injection well;

(e) determining a vapor transit time at a first station;

(f) repeating steps (c), (d), and (e) for a second station; and (g) calculating an amount of vapor and an amount of liquid entering a formation at various locations in said perforated zone based on said mass flow rate at said first and said second station of steam entering the well, said mass flow rate, and said vapor transit time at said first and said second station.

4. The method as recited in claim 2 wherein said thermally stable vapor phase tracer is selected from the group irradiated Argon, irradiated Krypton, or irradiated Xenon.

* * * * *

UNITED STATES PATENT AND TRADEMARK OFFICE

CERTIFICATE OF CORRECTION

PATENT NO. : 4,793,414

DATED : December 27, 1988

INVENTOR(S) : Tanh V. Nguyen et al

It is certified that error appears in the above-identified patent and that said Letters Patent is hereby corrected as shown below:

On the title page Inventors (75) add

"Ralph S. Millhone"

Under Related U.S. Application Data (63)
"Continuation-in-part" should read --Continuation--.

Signed and Sealed this

First Day of August, 1989

*Attest:*

*Attesting Officer*

DONALD J. QUIGG

*Commissioner of Patents and Trademarks*